US005678487A

United States Patent [19]

Guaraldi et al.

[11] Patent Number: 5,678,487

[45] Date of Patent: Oct. 21, 1997

[54] APPARATUS FOR MOUNTING FLEXIBLE PLATES IN A PRINTING UNIT

[75] Inventors: Glenn Alan Guaraldi, Kingston; Warren Hess Jarrard, Rochester; Edward E. Urquhart, Portsmouth, all of N.H.

[73] Assignees: Heidelberg Harris Inc., Dover, N.H.; Heidelberger Druckmaschinen AG, Heidelberg, Germany

[21] Appl. No.: 559,475

[22] Filed: Nov. 15, 1995

[51] Int. Cl.[6] ..... B41F 27/12

[52] U.S. Cl. ..... 101/415.1; 101/477

[58] Field of Search ..... 101/477, 415.1, 101/216

[56] References Cited

U.S. PATENT DOCUMENTS

| | | | |
|---|---|---|---|
| 3,858,513 | 1/1975 | Murata | 101/415.1 |
| 4,528,906 | 7/1985 | Hasegawa | 101/415.1 |
| 4,577,560 | 3/1986 | Banike | 101/415.1 |
| 4,727,807 | 3/1988 | Suzuki et al. | 101/415.1 |
| 5,211,112 | 5/1993 | Tsushima et al. | 101/415.1 |
| 5,293,820 | 3/1994 | Maejima et al. | 101/415.1 |
| 5,309,832 | 5/1994 | Merkel et al. | 101/216 |
| 5,339,738 | 8/1994 | Blaser et al. | 101/477 |
| 5,526,747 | 6/1996 | Marmin et al. | 101/477 |

FOREIGN PATENT DOCUMENTS

| | | |
|---|---|---|
| 0 531 748A1 | 3/1993 | European Pat. Off. . |
| 0 551 166A1 | 7/1993 | European Pat. Off. . |

*Primary Examiner*—Christopher A. Bennett

*Attorney, Agent, or Firm*—Burns, Doane, Swecker & Mathis, LLP

[57] ABSTRACT

The present invention is directed to an apparatus for mounting a printing plate on a printing unit cylinder, with the printing unit cylinder having an opening in a clamping area. A lock-up bar is slidably mounted in the opening of the printing unit cylinder, the lock-up bar having an element for retaining at least one edge of a printing plate. A tucking device substantially extends on the clamping area, the tucking device being provided with a protection element and with a plurality of tucking elements arranged over the clamping area and over the width of the printing unit cylinder.

21 Claims, 3 Drawing Sheets

APPARATUS FOR MOUNTING FLEXIBLE PLATES IN A PRINTING UNIT

BACKGROUND OF THE INVENTION

1. Field of the Invention

The present invention relates to an apparatus for mounting flexible plates in a printing unit, and in particular, to an apparatus having a cross member extending over the width of a printing unit.

2. State of the Art

U.S. Pat. No. 4,577,560 discloses a gapless lock-up for offset printing cylinders. As disclosed therein, a fixed jaw and a movable jaw are set into a cylinder or a rotary offset printing machine. They include facing undercut surfaces that define a recess within which end tabs of an offset plate or metal backed blanket are clamped firmly between the jaws. A slight tendency of the end tabs to bulge at the outer margin of the jaws is overcome by an anti-creep means which is disrobed between the end tabs as the jaws close to as to produce an inward force component on the end tabs.

European Patent document 0 531 748 A1 discloses a device for a plate exchange. A roller mounted in a sliding device is disposed opposite a clamping device in a gap of a printing unit cylinder. The outer circumference of the roller contacts the trailing edge of a printing plate upon movement of the roller perpendicular to the printing unit cylinder. Since the roller only covers a linear area, it is difficult to use the roller for smoothly contacting a printing plate's leading and trailing edges simultaneously.

U.S. Pat. No. 5,211,112 discloses an apparatus for mounting a plate on a plate cylinder. The apparatus includes a pair of right and left support levers, a plate press roller and a plate press pad having a spring member. The plate press roller urges the plate against the circumferential surface of the plate cylinder when the plate is wound on the plate cylinder. The plate press pad is fixed on a holding member to couple free end portions of the pair or support levers and has an elastic surface for pressing a trailing-side of the plate.

European Patent document 0 551 166 A1 shows a plate exchange apparatus for printing presses. Operating members, including a plate press roller, are assigned to a circumferential surface of a plate cylinder. The plate press roller inserts a leading end portion of a printing plate into gripper surfaces of a leading side plate lock-up device and inserts a trailing edge of the printing plate into gripper surfaces of a trailing side plate lock-up device assigned to the trailing edge of the printing plate. At the time the trailing edge is locked-up, the plate press roller does not urge both edges of the printing plate simultaneously into the respective plate lock-up devices with the plate cylinder in a defined rotational position. On the contrary, to allow for inserting both edges, the rotational position of the plate cylinder is changed between two defined positions during a plate exchange operation.

In the technical field, a problem has been encountered in that during a rise of temperature, a binding-phenomenon caused by thermal expansion can occur between a tucker bar and its housing, the housing being formed of material different than the tucker bar. For example, the tucker bar can be manufactured from a rigid material, whereas its housing may be made of aluminum. Both materials may have a different behavior concerning thermal expansion, which can cause binding. Furthermore, since the tucking device is encapsulated by a protection device which completely wraps around the thermal tucking device, sharp edges of a printing plate of aluminum can damage the protection device. During a sudden crack of the plate mounted on the printing unit cylinder, the protection device of the tucking device can be damaged as well.

SUMMARY OF THE INVENTION

Having described the state of the art and the drawbacks encountered in the technical field, it is accordingly an object of the present invention to protect a protection device assigned to a tucking device from a sudden impact.

Furthermore, it is an object of the present invention to provide for a uniformly distributed temperature profile in the tucking device.

A still further object of the present invention is to prevent components of the tucking device from binding to one another due to thermal expansion.

According to the present invention, an apparatus for mounting a printing plate on a printing unit cylinder comprises a printing unit cylinder having an opening in a clamping area of said printing unit cylinder; a lock-up bar slidably mounted in said opening of said printing unit cylinder, said lock-up bar having an element for retaining at least one edge of a printing plate; and a tucking device substantially extending over said clamping area, said tucking device being provided with a protection element and a plurality of tucking elements, said plurality of tucking elements being arranged opposite said clamping area and over a width of said printing unit cylinder.

According to further embodiments of the present invention, a tucking device is provided which is completely encapsulated in said protection element, said protection element being, for example, a protective sleeve having a pretensioning unit assigned thereto. The tucking elements assigned to said tucking device are arranged spaced from one another across the width of said printing unit cylinder. By means of fasteners, the tucking elements are attached to sections of a tucking bar, the fasteners being, for example, screws such as flat-head screws.

In accordance with exemplary embodiments, the tucking elements substantially extending over those sections of the protective sleeves exposed to the clamping area can have different configurations. For example, they can be manufactured to have an arc-shape or to have an angled configuration, such as an L-shape or an U-shape. The material the tucking elements are manufactured of can be, for example, an elastic material, or a rubber-like material, providing a certain compressibility. In addition, semi-rigid plastic material or composite materials can be used.

The tucker bar itself either being a single bar extending over the width of the printing unit cylinder, or including different single sections, can be activated by way of pistons subjected to a pressure medium. The retraction of the tucker bar or tucker bar sections respectively, can be achieved mechanically by the use of spring loaded bolts mounted to a spring keeper.

BRIEF DESCRIPTION OF THE DRAWINGS

These and other features and advantages of the invention will be more readily apparent upon reading the following description of a preferred embodiment of the invention and upon reference to the accompanying drawings, wherein.

DETAILED DESCRIPTION OF THE PREFERRED EMBODIMENTS

Figure 1:
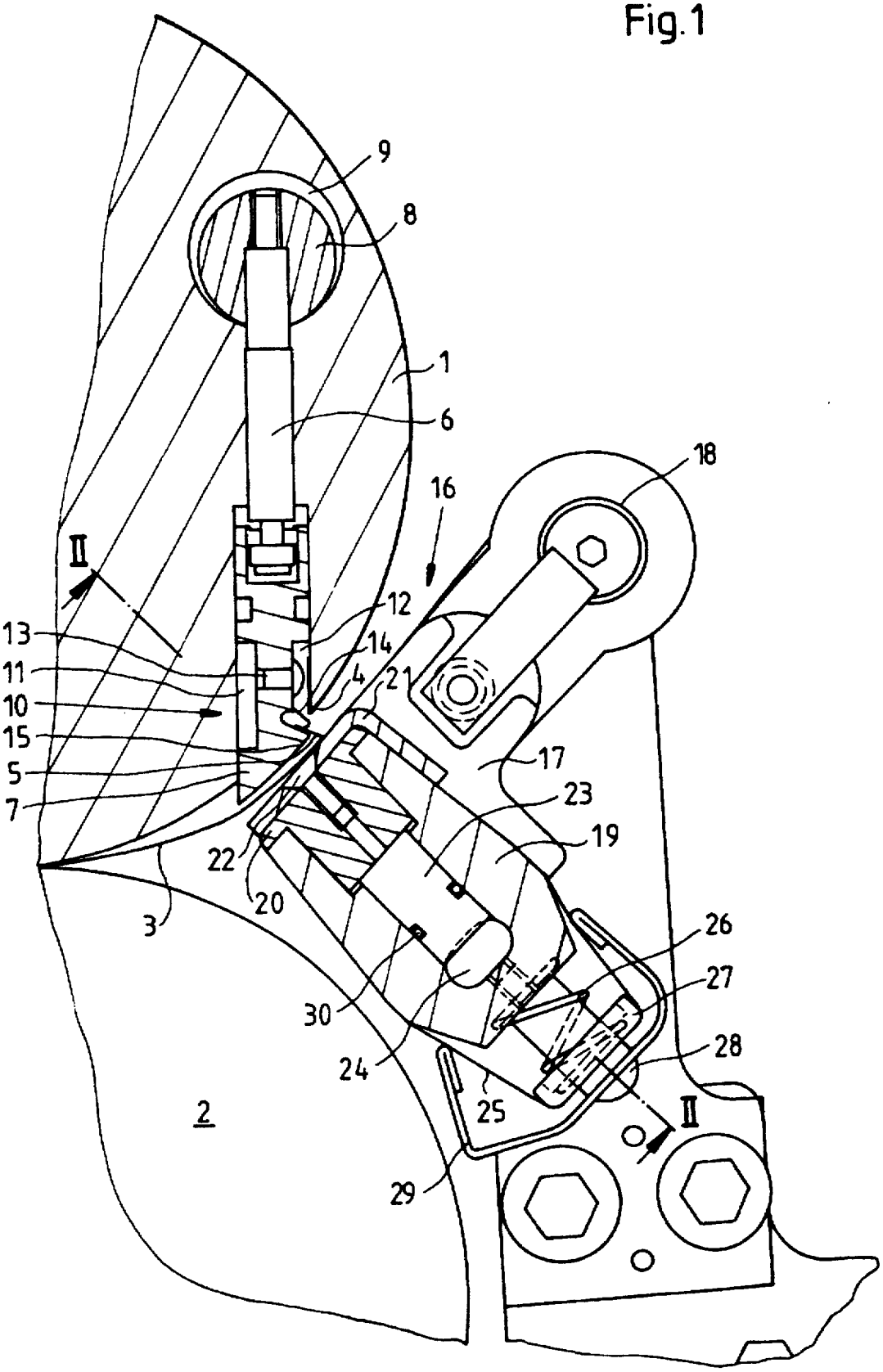
FIG. 1 shows a tucking device assigned to a printing unit cylinder according to an exemplary embodiment of the present invention.

FIG. 1 shows an exemplary embodiment of a tucking device 16 assigned to a printing unit cylinder assembly of a rotary printing unit, the printing unit having a printing unit cylinder 1 and a blanket cylinder 2. FIG. 1 shows a tucker bar which is about to tuck a printing plate 3 into a lock-up bar 7.

The printing plate 3, having a leading edge 4 and a trailing edge 5, is mounted on a surface of a printing unit cylinder 1. Within the printing unit cylinder 1, there is arranged an elongated body 6 (e.g. a connecting pin) having a clamping assembly 10 and a balance bar 8. The balance bar 8 is mounted within a bore 9 of the printing unit cylinder 1. The balance bar 8 has a force tensioning means (such as a spring as described in copending U.S. patent application Ser. No. 08/429,491, filed Apr. 26, 1995, entitled: METHOD AND APPARATUS FOR MOUNTING A PRINTING PLATE ON A CYLINDER, the disclosure of which is hereby incorporated by reference) assigned thereto which is not shown. The clamping assembly 10 of the elongated body 6 has a left recess 11 and a right recess 12. By means of a fastener 13, such as a rivet or a screw, a retaining element 14 is mounted within the right recess 12 of the clamping assembly 10. The retaining element 14 retains the trailing edge 5 of plate 3 on the lock-up bar 7 of the clamping assembly 10. The lock-up bar 7 has an outer surface 15 matching with the printing unit cylinder's outer circumference curvature.

Opposite the printing unit cylinder 1, the tucking device 16 is pivotably mounted about a pivot axis 18. A tucker body, or housing 19 is mounted on a support 17 which is pivotable about the axis 18. The tucker housing 19 is completely wrapped by a protective element which, for example, is a protective sleeve 25. In the lower side of the tucker housing 19, a tensioning bar or plate 27 is mounted. The tensioning plate or bar 27 is pretensioned by means of, for example, a spring 26, which is arranged between the tucker housing 19 and the tensioning plate or bar 27.

The spring 26 urges the tensioning plate or bar 27 against the protective sleeve 25 to keep it tightened around the tucker housing 19 and a tucker bar 20. The tensioning plate or bar 27 is guided by means of, for example, a bolt 28 centering a guiding element (e.g., sleeve) 35 (see FIG. 4) on which the tensioning plate or bar 27 is slidably mounted. By means of the bolt 28, there is mounted a U-shaped bent shield 29 to protect the tightened portions of the protective element 25 (i.e., those portions which do not contact the tucker housing 19). The tucker housing 19 houses the tucker bar 20 which is actuable by a piston 23 integrated into the tucker housing 19. Below the piston 23, there is arranged one or more heating elements 24 which will be readily understood by those skilled in the art and therefore need not be shown in greater detail. The tucker bar 20 is wrapped by the protective sleeve 25, which in turn is covered along the width of the printing unit cylinder 1, by one or more tucking elements 21. The tucking elements 21 are fastened to the tucker bar 20 or corresponding tucker bar sections by means of fasteners 22, such as rivets or screws (for example, screws having a flat head). The flat heads of the screws will completely dive into the fastening bores applied to the tucking elements 21 in order to provide for an extremely smooth and flat surface of the tucking elements 21 which is not disturbed by the heads of the fasteners 22 (e.g., the screws are recessed into the fastening bores as shown in FIG. 1).

In order to provide tucking elements 21 with a surface that will not damage the surface of a plate 3 to be mounted onto the printing unit cylinder 1, the tucking elements 21 are made of a semi-rigid material or of a material such as rubber or any composite material. In accordance with exemplary embodiments, materials can be used which have a surface hardness which is lower than the surface hardness of the printing plate 3 to be mounted. As can be understood from FIG. 1, the tucking elements 21 contact the surface of the printing plate's trailing edge 5 upon insertion into the opening of the printing unit cylinder 1. The tucking elements 21 can be shaped such that the upper portion of the protective sleeve 22 around the tucker body 19 is prevented from contacting the surface of the printing plate 3. Consequently, upon a sudden plate crack, the protective sleeve 25 would not be contacted by the cracking plate 3. The tucking elements can be formed with any shape including, for example, an "L" shape, an arc-shape or a U-profile. Upon a tucking movement by the tucker bar 20, the protective sleeve 25 is kept in its tightened state by means of the tensioning springs 26 and the tensioning bar or plate 27.

The actuation of the tucker bar 20 by means of the piston 23 will be described in more detail with respect to FIG. 2.

Figure 2:
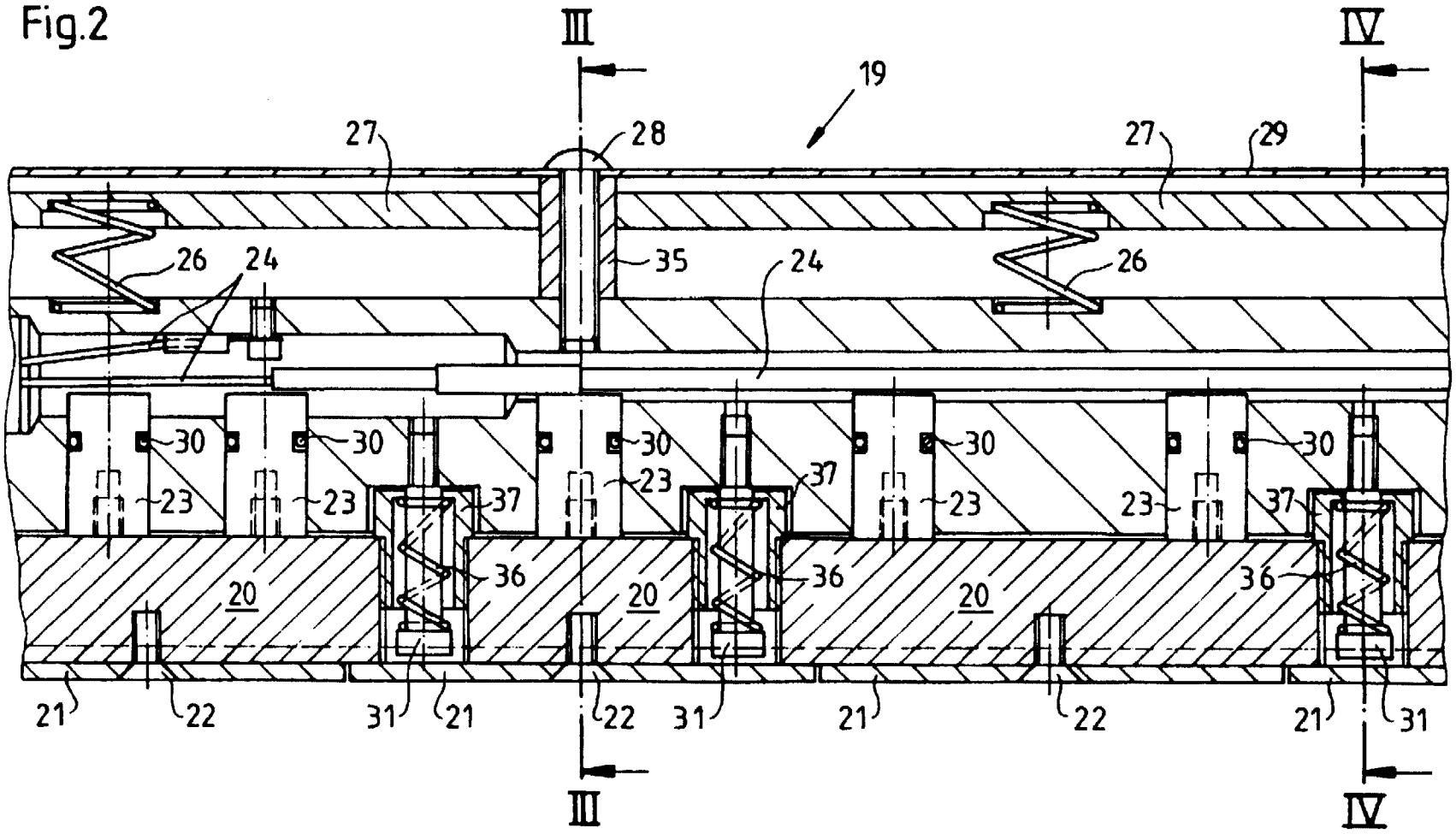
FIG. 2 shows a cross-sectional view along lines II—II of the FIG. 1 tucking device.

FIG. 2 shows a cross sectional view along the dashed lines I—I of the FIG. 1 tucking device 16. Referring to the exemplary embodiment of FIG. 2, plural pistons 23 and plural bolts 31 are assigned to the tucker bar 20, and extend over the width of the printing unit cylinder 1 for resetting (e.g., retracting) the tucker bar 20 into its disengaged position. The bolts 31 can be shoulder bolts mounted to the tucker body 19 and arranged over the width of the tucker body 19. A number of pistons 23 are assigned to the printing unit cylinder 1 in order to achieve a uniform force of the tucker bar 20 out of the tucking device 16 onto printing unit cylinder 1. For reasons of clarity, the protective sleeve 25 is not shown in FIG. 2. The plural tucking elements 21 are mounted, spaced from each other, onto the tucker bar 20. In accordance with exemplary embodiments, to allow for thermal expansion, the tucking elements 21 are spaced from each other approximately 0.03 inches. In alternate embodiments, the separation gap between adjacent tucking elements can be increased or decreased to accommodate a specific implementation.

As can be seen in FIG. 2, the heating elements 24 extend axially through the tucker body 19 slightly below the pistons 23, each having a sealing element 30 assigned thereto. Bolts 28 are screwed into the tucker body 19, each centering a guiding element 35. The bolts 28 centering the guiding elements 35 are arranged spaced apart from each other over the width of the tucker body 19. The guiding elements 35 guide the tensioning plate or bar 27 which is pretensioned by the spring means 26. Additionally, the shield 29 is mounted on the bolts 28.

Figure 3:
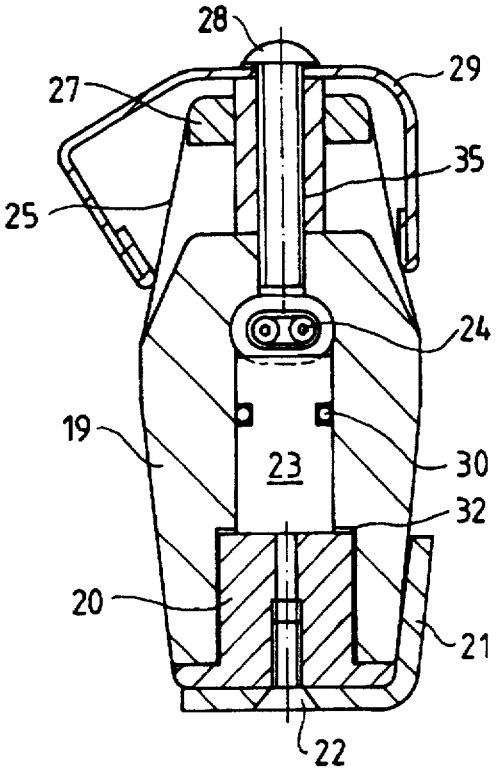
FIG. 3 shows a cross-sectional view along lines III—III of the FIG. 2 tucking device.

In FIG. 3 a cross sectional view along the dashed lines III—III of FIG. 2 is shown in greater detail.

Figure 4:
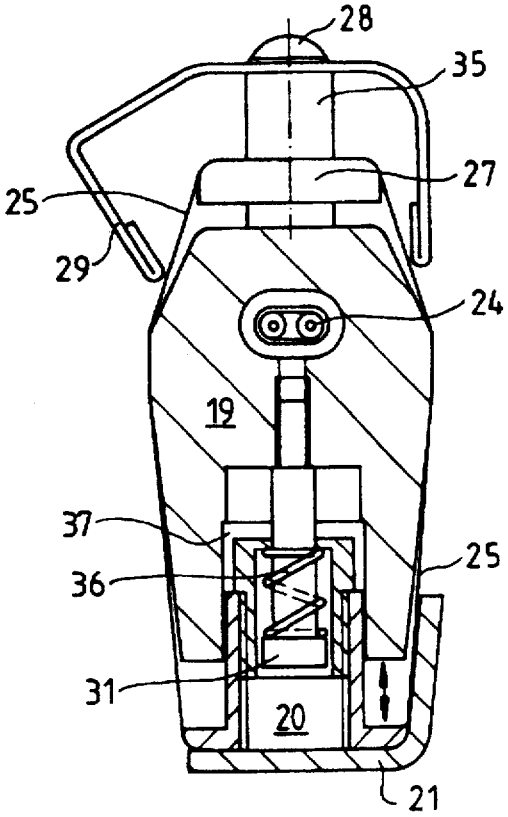
FIG. 4 shows a cross-sectional view along lines IV—IV of the FIG. 2 tucking device.

Referring to FIG. 3, the piston 23 arranged between the tucker bar 20 and the heating elements 24 urge the tucker bar 20 out of its recess (see FIG. 4). In the stage given in FIG. 3, the tensioning bar or plate 27 is pretensioned by means of springs 26 keeping the protective sleeve 25 tightened. The sealing 30 seals a recess 32 against a pressure medium applied to the piston 23 to actuate the tucker bar 20. In the position given in FIG. 3, the tucking element 21 is in a disengaged position, the protective sleeve 25 being tightened by a spring and extending into a shield 29.

In FIG. 4, a cross sectional view along the lines IV—IV of FIG. 2 within the tucker body 19 is shown. In FIG. 4, the tucking elements 21 are shown in their engaged position, thus inserting the trailing edges 5 of a printing plate 3 into a respective opening on the printing unit cylinder 1. By means of the pistons 23, the tucker bar 20 has been moved into its engaged position. Consequently, the protective sleeve 25 has moved in the moving direction of the tucker bar 20. Since the protective sleeve fully covers the tucker bar 20, the spring 26 (FIG. 2) is pretensioned accordingly, compressed by the tensioning bar or plate 27.

In turn, a spring keeper 37 (FIG. 2) connected to the tucker bar 20 is moved when the tucker elements 21 are in their engaged position, thus compressing a spring 36. The force to keep the tucker bar 20 in its engaged position is exerted by the pistons 23 only, which are subjected to a pressure. Upon release of the pressure, the compressed spring 36 moves the spring keeper 37 in the direction of the heating elements 24 (see FIG. 4). Thus, the spring 36 along with the spring 26 resets (e.g., retracts) the tucker bar 20 and consequently the tucking elements 21 attached thereto into the reset position.

In the exemplary embodiment illustrated, the tucking elements 21 have an "L"-shaped configuration covering the top of the tucker bar 20 and a side portion thereof and portions of the protective sleeve 25. The portions of the tucking element 21 covering side portions of the protective sleeve 25 are arranged on the side of the tucking housing 19 encountered first by a rotating plate, i.e. in the sense of rotation of the printing unit cylinder 1. Thus, those portions of the protective sleeve 25 not supported by the tucker housing 19 but exposed due to the movement of the tucker bar 20 are protected.

Figure 5:
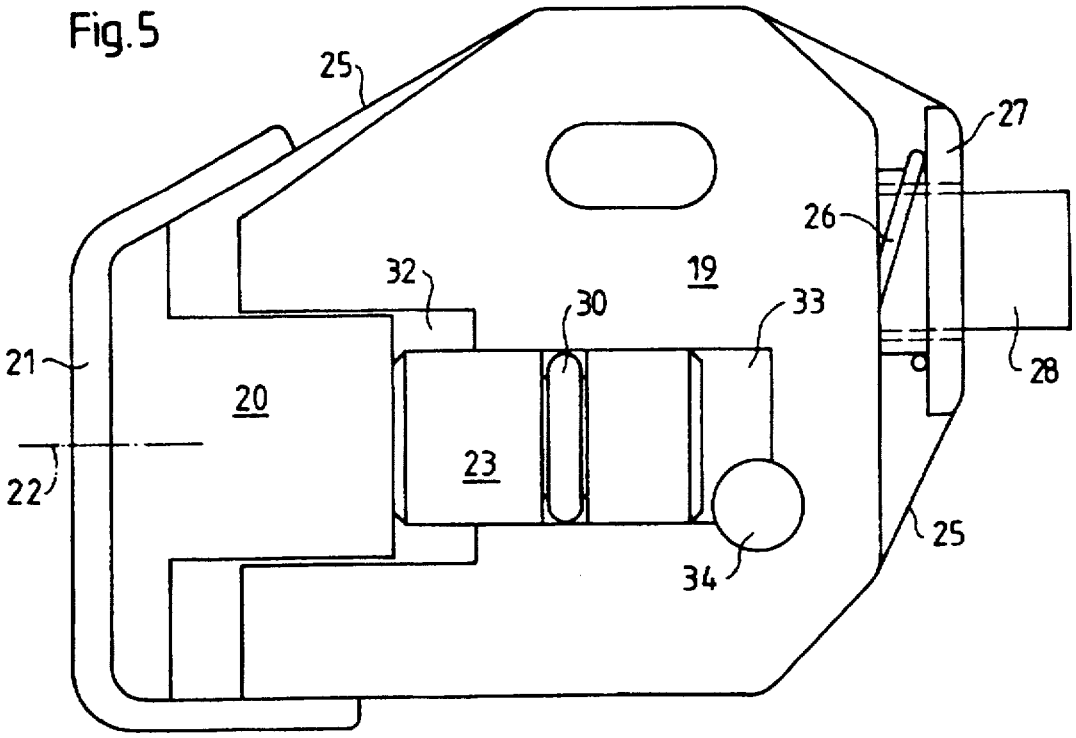
FIG. 5 shows an exemplary schematic of a supply of a pressure medium to the tucking device.

FIG. 5 schematically shows an exemplary embodiment of a tucker housing 19 wrapped by protective sleeve 25. A U-shaped tucking element 21 is assigned to the tucker bar 20, the tucking element being fastened by a fastener 22, such as a rivet or a flat head socket screw. The tucker bar 20 and consequently the tucking element 21 are actuated by a piston 23 to which a pressure medium is applied via a pressure supply line 34. A pressure chamber 33 into which the supply line 34 extends is sealed against a recess 32 by means of a sealing 30 mounted on the piston 23. The pressure medium can be compressed air, hydraulic fluid, or any other fluid type.

In accordance with exemplary embodiments, any material can be used for the tucking elements 21, including any kind of plastics and/or composite materials. In exemplary embodiments, the coefficient of thermal expansion of the material selected for use as tucking elements can be matched to the coefficient of thermal expansion of the material selected for the tucking device housing. A semi-rigid material can also be used, the material, having a flat and even surface allowing for a smooth sliding movement of the edges of the printing plate 3 upon mounting the plate on the cylinder. Furthermore, a material having elasticity selected to correctly insert the plate edges 4, 5 into the respective opening of the plate cylinder 1 can be used, such that a smoothening of the plate in the clamping area can be obtained.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. Apparatus for mounting a printing plate on a printing unit cylinder comprising:

a printing unit cylinder having an opening in a clamping area of said printing unit cylinder, a lock-up bar slidably mounted in said opening of said printing unit cylinder, said lock-up bar having an element for retaining at least one edge of a printing plate; and a tucking device substantially extending over said clamping area, said tucking device being provided with a protection element and at least one tucking element, said at least one tucking element being arranged opposite said clamping area and over a width of said printing unit cylinder.

2. Apparatus according to claim 1, wherein said protection element encapsulates said tucking device.

3. Apparatus according to claim 1, wherein said protection element is a protective sleeve.

4. Apparatus according to claim 1, further comprising:

a plurality of tucking elements, wherein said plurality of tucking elements are spaced from one another over the width of said printing unit cylinder.

5. Apparatus according to claim 4, wherein said tucking device further includes a tucker bar and fasteners, said tucking elements being attached to sections of said tucker bar by said fasteners.

6. Apparatus according to claim 1, wherein said at least one tucking element is arc-shaped.

7. Apparatus according to claim 1, wherein said at least one tucking element is L-shaped.

8. Apparatus according to claim 1, wherein said at least one tucking element is made of an elastic material.

9. Apparatus according to claim 1, wherein said at least one tucking element is made of rubber-like material.

10. Apparatus according to claim 1, wherein said at least one tucking element is made of a semi-rigid plastic-type material.

11. Apparatus according to claim 1, wherein said at least one tucking element is made of a composite material.

12. Apparatus according to claim 5, wherein said fastener is a flat-head socket screw.

13. Apparatus according to claim 5, wherein said tucking device further includes a piston, said tucker bar being activated via said piston extending into a recess of said tucking device which houses said at least one tucking element in its disengaged position.

14. Apparatus according to claim 13, wherein said tucking device further includes a spring-loaded bolt and a movably mounted spring keeper, said tucker bar being reset by said spring-loaded bolt abutting said movably mounted spring keeper.

15. Apparatus according to claim 14, wherein said spring keeper is attached to said tucker bar.

16. Apparatus according to claim 1, wherein said at least one tucking device further includes:

a tucker housing, said tucker housing and said at least one tucking element being formed of materials having matched coefficients of thermal expansion.

17. Apparatus for mounting a printing plate on a printing unit cylinder comprising:

a printing unit cylinder having an opening in a clamping area of said printing unit cylinder, and a tucking device substantially extending over said clamping area, said tucking device being provided with a protection element and at least one tucking element, said at least one tucking element being arranged opposite said clamping area and over a width of said printing unit cylinder.

18. Apparatus according to claim 17, wherein said protection element encapsulates said tucking device.

19. Apparatus according to claim 17, wherein said protection element is a protective sleeve.

20. Apparatus according to claim 17, further comprising:

a plurality of tucking elements, wherein said plurality of tucking elements are spaced from one another over the width of said printing unit cylinder.

21. Apparatus according to claim 20, wherein said tucking device includes a tucker bar, and said tucking elements are attached to sections of said tucker bar by fasteners.

* * * * *